US008844613B2

(12) United States Patent
Shah et al.

(10) Patent No.: US 8,844,613 B2
(45) Date of Patent: Sep. 30, 2014

(54) SHEAR BLADE AND METHOD OF ATTACHMENT TO SHEAR RAMS

(75) Inventors: Viral Shah, Houston, TX (US); William L. Carbaugh, Humble, TX (US); Leonard G. Childers, Kingwood, TX (US)

(73) Assignee: Hydrill USA Manufacturing LLC, Houston, TX (US)

( * ) Notice: Subject to any disclaimer, the term of this patent is extended or adjusted under 35 U.S.C. 154(b) by 348 days.

(21) Appl. No.: 13/338,862

(22) Filed: Dec. 28, 2011

(65) Prior Publication Data

US 2013/0168075 A1 Jul. 4, 2013

(51) Int. Cl.
*E21B 29/00* (2006.01)

(52) U.S. Cl.
USPC ..... 166/55; 166/85.4

(58) Field of Classification Search
CPC ..... E21B 33/063
USPC ..... 166/55, 85.4; 251/1.3
See application file for complete search history.

(56) References Cited

U.S. PATENT DOCUMENTS 2,969,838 A * 1/1961 Wilde ..... 166/55
3,736,982 A * 6/1973 Vujasinovic ..... 166/55
4,347,898 A 9/1982 Jones
4,540,046 A * 9/1985 Granger et al. ..... 166/55
5,515,916 A * 5/1996 Haley ..... 166/55
8,464,785 B2 * 6/2013 Carbaugh et al. ..... 166/55
2011/0226476 A1 9/2011 Springett et al.

FOREIGN PATENT DOCUMENTS

SU 883329 A 11/1981

OTHER PUBLICATIONS

Eurasian Search Report dated Apr. 29, 2013 from corresponfing EA Application No. 201201641.

* cited by examiner

*Primary Examiner* — William P Neuder
(74) *Attorney, Agent, or Firm* — Bracewell & Giuliani LLP

(57) ABSTRACT

A shear blade attached to a ram block. At least one bolt passage is formed at an angle at the top of the ram block. A bolt passage is formed in the shear blade that corresponds with the bolt passage on the tam block. A bolt introduced into the bolt passage of the ram block and also the bolt passage in the shear blade attaches the shear blade to the ram block. By using this technique for attaching the shear blade to the ram block, surface area of a front face of the shear blade is not further reduced. Therefore, the strength of the shear blade is increased.

18 Claims, 5 Drawing Sheets

SHEAR BLADE AND METHOD OF ATTACHMENT TO SHEAR RAMS

FIELD OF THE INVENTION

This disclosure relates in general to drilling and in particular to an improved shear blade attached to shear rams for a blowout preventer.

BACKGROUND OF THE INVENTION

In offshore drilling operations, the operator will perform drilling operations through a drilling riser. The drilling riser extends between the subsea wellhead assembly at the seafloor and the drilling vessel. The drilling riser is made up of a number of individual joints or sections. These sections are secured to each other and run from a riser deploying floor of the drilling vessel. The drilling riser also normally has a number of auxiliary conduits that extend around the main central pipe. Some of the auxiliary conduits supply hydraulic fluid pressure to a subsea blowout preventer (BOP) installed on the subsea wellhead to control the well.

A BOP assembly may be part of a stack assembly which may be located at the lower end of the riser extending downward from the drilling vessel. The BOP stack assembly will normally contain shear rams, pipe rams, variable bore rams, annular closure member, and a quick disconnect mechanism for disconnecting from the riser in the event of an emergency. When actuated, shear rams will close the through bore and also shear pipe in the well, such as drill pipe, tubing, or casing. A shear blade may be attached to a ram block via a plurality of bolts that pass through a front face of the shear blade and threadingly engage the ram block. Further, the bolts aid in resisting forces during shearing and also from the wellbore pressure. However, a counterbore for each of the bolts on the front face of the shear blade reduces the area of the blade, thereby reducing the strength of the blade. An improved technique for attaching the shear blade to the ram block is therefore needed.

SUMMARY OF THE INVENTION

These and other problems are generally solved or circumvented, and technical advantages are generally achieved, by preferred embodiments of the present invention that provide a method of attaching a shear blade to shear rams.

An embodiment of the present invention provides a shear ram assembly comprising of a shear blade attached to a ram block. A similar shear blade and ram block is opposite from and offset to the aforementioned shear blade and ram block. At least one bolt passage is formed at an angle at the top of the ram block. A bolt passage is formed in a back face of shear blade that corresponds with the bolt passage on the ram block. A bolt introduced into the bolt passage of the ram block and also the bolt passage in the shear blade attaches the shear blade to the ram block. The bolt may threadingly engage the bolt passage in the shear blade. Further, at least one bolt passage is formed on the face of the shear blade that registers with a bolt passage formed on a face of the ram block. The bolt passages on the shear blade and ram block faces allow a bolt to be introduced into the passages and threadingly engage the ram block to provide additional connection stability of the shear blade with the ram block.

The technique of connecting the shear blade to the ram block utilizing the angled bolt passages at the top of the ram block and back face of the shear blade advantageously increase the strength of the shear blade by increasing the surface area of the front face of the shear blade because no additional material must be removed from the front face for additional bolt passages.

DETAILED DESCRIPTION

Figure 1:
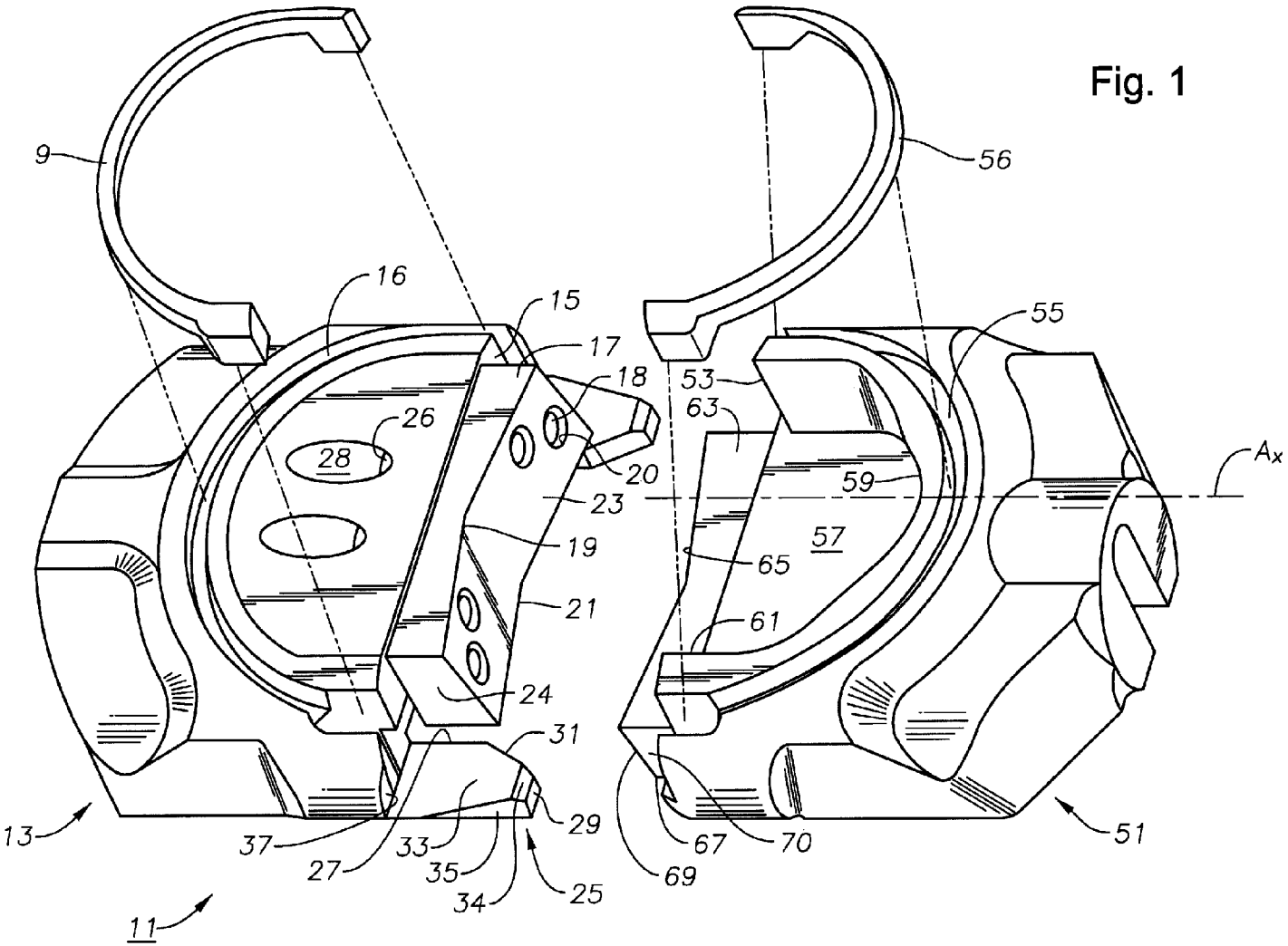
FIG. 1 is a perspective view of the ram blocks of a shear ram assembly in accordance with this disclosure.

Referring to FIG. 1, shear rams or blind shear rams 11 are shown removed from the housing or bonnet in which they are located. Shear rams 11 are part of a ram BOP assembly that is part of a stack assembly, which is located at the lower end of a riser extending downward from a drilling vessel. The lower end of the BOP stack assembly secures to a subsea wellhead on the sea floor. The BOP stack assembly will normally also contain pipe rams, variable bore rams, an annular closure member, and a quick disconnect mechanism for disconnecting from the riser in the event of an emergency. When actuated, shear rams 11 will close the through bore and also shear pipe in the well, such as drill pipe, tubing, or casing.

Shear rams 11 include an upper ram assembly 13 having a forward end 15. A semi-circular seal groove 16 is located on the upper side of upper ram block 13 for receiving a portion of an elastomeric seal 9. An upper shearing blade 17 mounts to forward end 15. In this embodiment, a plurality of bolts 18 may be introduced into bolt passages 20 extending from a forward face 23 of the upper shearing blade 17 to a rearward face. The bolt passages 20 are parallel to axis Ax and form a counterbore at the forward face 23 of the upper shearing blade 17. Each of the plurality of bolts 18 continues into bolt passages 22 (FIG. 3) formed on the forward end 15 of the upper ram assembly 13, which register with the bolt passages 20 of the upper shearing blade 17. The bolts 18 may have a threaded exterior profile to correspond with a threaded inner profile of the bolt passages 20, 22. The size of the bolts 18 can vary depending on the shear forces experienced and the well pressures.

In addition to the bolts 18 entering through the forward face 23 of the upper blade 17, at least one angled bolt 26 is introduced into an angled bolt passage 28 formed on an upper surface of the upper ram assembly 13. In the embodiment shown, there are two angled bolt passages, each on an opposite side of axis Ax. The angled bolt 26 and angled bolt passage 28 is discussed further below at FIG. 3A. The entrance of angled bolt passage 28 is located inward or forward from seal groove 16.

Continuing to refer to FIG. 1, the forward face 23 of upper blade 17 has an upper edge 19 and a lower edge 21. Lower edge 21 extends forward farther than upper edge 19 in this example, resulting in face 23 inclining relative to vertical. Face 23 is also generally concave, resulting in the center of face 23 between its outboard ends 24 being recessed relative to the more forward portions of face 23 at outboard ends 24. A variety of different shapes for upper blade 17 may be employed.

Pipe guide arms 25 may be located on the outboard sides of upper ram block forward end 15. Each arm 25 could be formed integrally with upper ram block 13, but they could be otherwise attached, such as by welding or fasteners. Each arm 25 has a vertically oriented inboard side 27 and a forward end or tip 29. A wedge surface 31 extends from a forward part of inboard side 27 to tip 29. Each inboard side 27 is parallel with the longitudinal axis Ax of shear rams 11 in this example. Wedge surface 31 may be a flat vertical surface, as shown, that is at an acute angle relative to longitudinal axis Ax. In this embodiment, wedge surface 31 is at an angle of about 30 degrees relative to longitudinal axis Ax. Rather than flat, wedge surface 31 could be a curved surface. Each guide arm 25 has an upper side 33 that is flat and in a horizontal plane in this example. A chamfer or bevel 34 optionally may be at the intersection of upper side 33 with tip 29.

Figure 2:
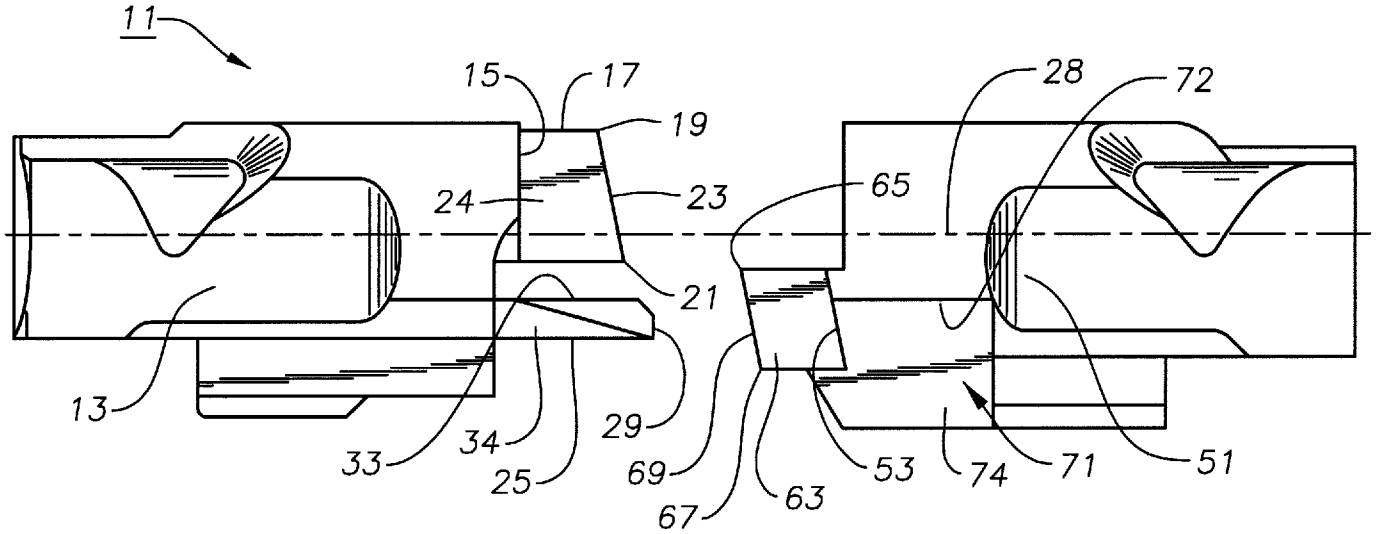
FIG. 2 is a side view of the ram blocks of FIG. 1.
Figure 3:
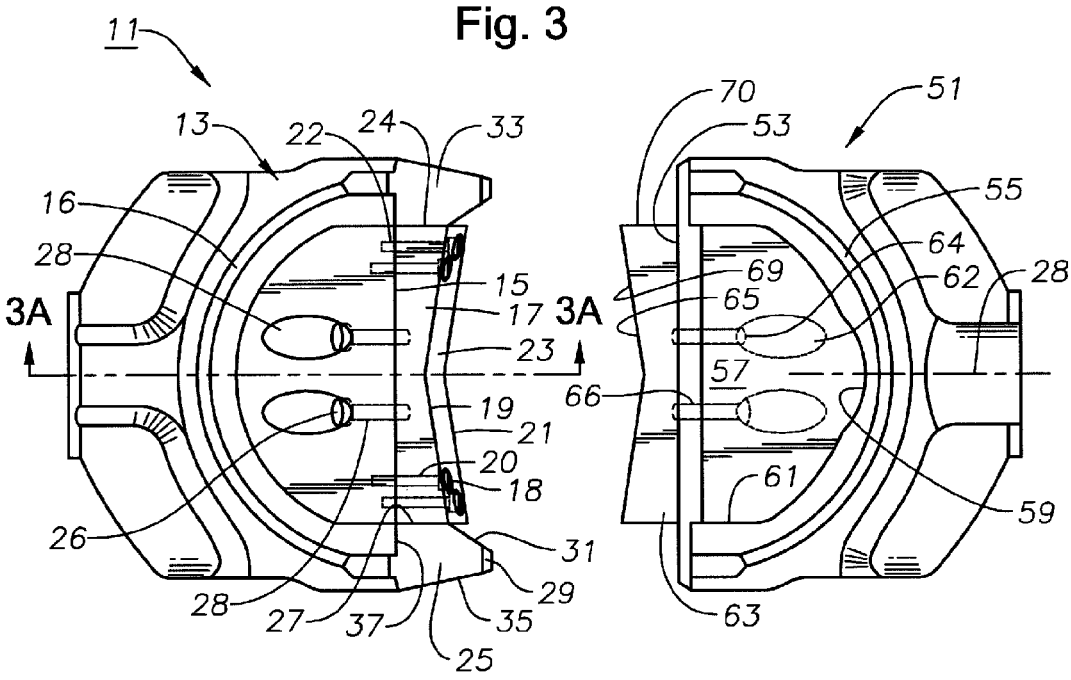
FIG. 3 is a top view of the ram blocks of FIG. 1.

As shown in FIG. 2, upper side 33 is spaced at a lower elevation on upper ram block forward end 15 than upper blade lower edge 21. Upper side 33 is not located directly under upper blade 17 in this example because inboard side 27 of each arm 25 is approximately the same outboard distance as one of the upper blade outboard ends 24, as shown in FIG. 3. Also, FIGS. 2 and 3 illustrate that tip 29 extends forwardly more than upper blade 17. The junction of inboard side 27 with wedge surface 31 is approximately in vertical alignment with the junction of upper shear blade upper edge 19 and outboard end 24. Wedge surface 31 joins inboard side 27 approximately the same distance from upper ram block forward end 15 as the distance from forward end 15 to the upper edge 19 of upper blade face 23 at outboard end 24.

Each guide arm 25 has an outboard side 35 that extends from a base 37, where arms 25 join upper ram block 13, to tip 29. Outboard side 35 may be at an acute angle relative to longitudinal axis Ax. In this embodiment, the acute angle is about 15 degrees relative to longitudinal axis. Tip 29 has a smaller height and width than base 37.

Figure 3A:
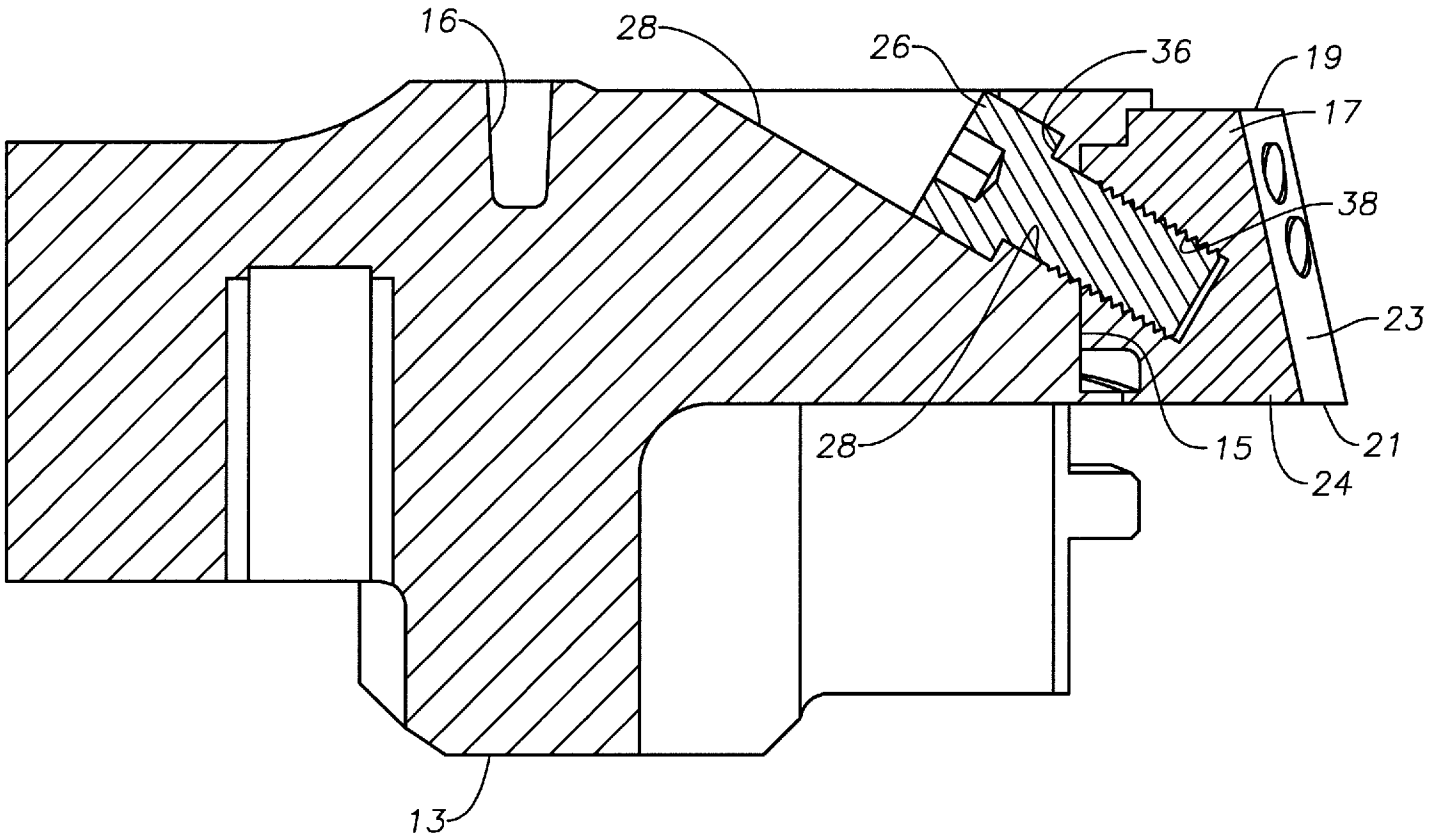
FIG. 3A is a side sectional view of one of the ram blocks of FIG. 1.

FIG. 3A shows a section of the upper shearing blade 17 and upper ram block 13. As previously explained, the at least one angled bolt 26 is introduced into the angled bolt passage 28 formed on the upper surface of the upper ram block 13. The angled bolt passage 28 extends downward through the forward end 15 of the upper ram block 13 and may have an angle range relative to the axis Ax that is approximately between about 15 degrees to about 45 degrees. The angled bolt passage 28 may be reduced once in diameter, forming a shoulder 36 on which a head of the bolt 26 can stop. The angled bolt 26 continues through the angled bolt passage 28 and into a angled blade bolt passage 38 formed in the rearward face of the upper blade 17, where the blade angled blade bolt passage registers with the angled bolt passage on the ram block 13. The angled blade bolt passage 38 terminates within the upper blade 17 before reaching the forward face 23 of the upper blade. The angled bolt 26 may have a threaded exterior profile to correspond with a threaded inner profile of the angled bolt passages 28, 38. The size of the angled bolts 26 can vary depending on the shear forces experienced and the well pressures. By attaching the upper blade 17 to the ram block 13 utilizing the angled bolts 26 and angled bolt passages 28, 38 at the upper surface of the ram block and on the upper blade 17, respectively, less material is removed at the forward face 23 of the upper blade. This results in a maximized surface area for the front face 23 of the upper shear blade 17, which translates to increased strength of the upper shear blade. The figures show four bolts 18 entering the forward face 23 of the upper blade 17 and two angled bolts 26 entering through the upper surface of the ram block 13 to secure the upper blade to the ram block. However, it is understood that various combinations of bolts 18 and angled bolts 26 may be used depending on the applications and well pressure conditions. Further, the size of the bolts 18, 26 to be utilized may also impact the number of bolts to be used.

Figure 4:
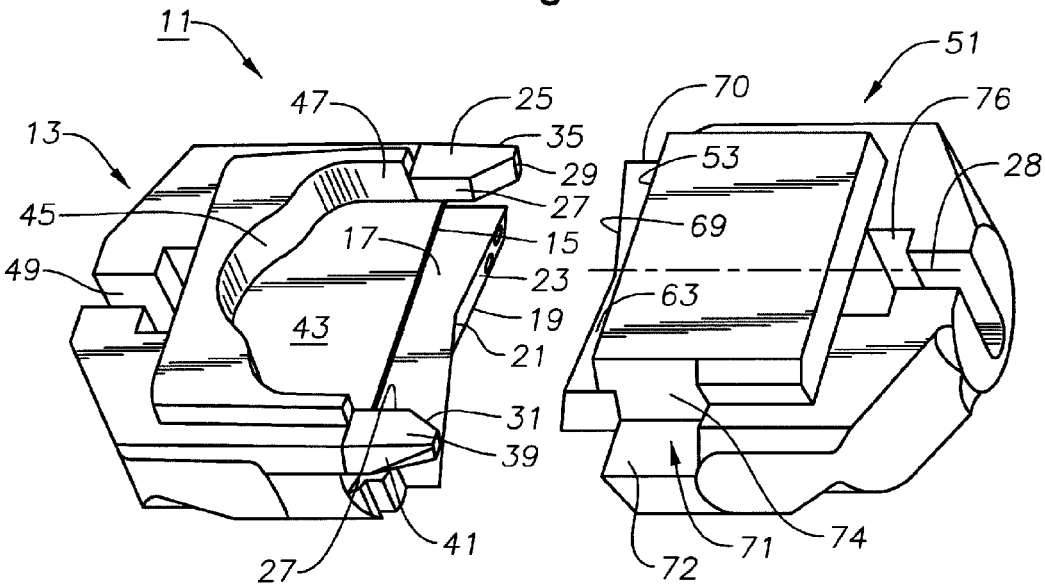
FIG. 4 is a bottom perspective view of the ram blocks of FIG. 1.

FIG. 4 shows a lower side 39 of each arm 25. Lower side 39 is shown as being flat and in a plane parallel with upper side 33 (FIG. 3). A beveled surface 41 may join an outboard edge of lower side 39 with outboard side 35. Beveled surface 41 is shown to be in a plane inclined relative to horizontal.

Figure 5:
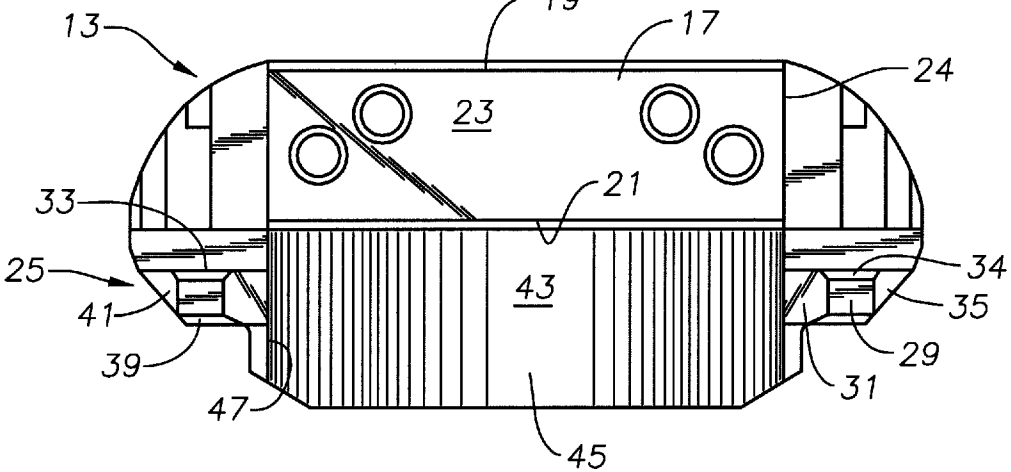
FIG. 5 is a front view of the upper ram block of FIG. 1.

Referring still to FIG. 4, and also to FIG. 5, the lower side of upper ram block 13 has a sheared pipe end recess 43. Recess 43 has a rear wall portion 45 that joins side wall portions 47. Wall portions 45 and 47 are vertical walls positioned to receive the upper end of a well pipe after it has been sheared. Rearward wall portion 45 is illustrated as being partially cylindrical and blends with side wall portions 47, which are straight. Other shapes for shear pipe end recess 43 are feasible. FIG. 4 also illustrates a T-shaped connector slot 49 on the rearward end of upper ram block 13 for connecting to a piston rod.

Referring again to FIG. 1, a lower ram block 51 is illustrated in horizontal alignment with upper ram block 13. Lower ram block 51 has a forward end 53 that is parallel to forward end 15 of upper ram block 13. A top seal groove 55 in the upper side of lower ram block 51 receives an elastomeric seal 56 and aligns with seal groove 16 to form a continuous (note that the seal is not necessarily "circular") seal when ram blocks 13, 51 are in abutment with each other. Lower ram block 51 has a sheared pipe end recess 57 for receiving the lower end of well pipe after shearing. Sheared pipe end recess 57 has a curved rear wall portion 59 that blends with two straight side wall portions 61. Other shapes are feasible.

In this embodiment, ram blocks 13 and 51 are designed to be pressure assisted in closing. The seals 9 and 56 in the semi-circular grooves 9 and 55 enable this pressure assist. Securing a RAM shear blade to a RAM block with a fastener that extended through the RAM block from the back side to the front side would create a path for pressure to leak by seals 9 and 56 unless an additional seal were provided around the fastener. In this case, the angled bolt passage 28 to secure the blade lies completely on the interior bore side of the seal 9, 56 so that there is no chance for pressure to leak by and diminish the pressure-assist element. Further, since the angle bolt passage 28 is forward of seal groove 16 and seal 9, it is not necessary to seal around each bolt passage. The passage 28, as previously explained, does not cross the seal grooves 16 and 55 but is instead located entirely in the pressure zone sealed by seals 9 and 56. However, in an alternative embodiment, the passage 28 may bypass the seals 9 and 56.

A lower blade 63 attaches to forward end 53 of lower ram block 51. Lower blade 63 is at a lower elevation than upper blade 17, as illustrated in FIG. 2. It is understood that lower shearing blade 63 may attach to forward end 53 of lower ram block 51 in a similar way to that described for the upper shearing blade 17 and is thus similarly described in FIG. 3A. Thus lower blade 63 may also have angled bolt passages 62 formed on the lower surface of the lower ram block 51 as shown in FIG. 3. At least one angled bolt 64 is introduced into the angled bolt passage 62. The angled bolt passage 62 extends downward through the forward end 53 of the lower ram block 51 and may have an angle range relative to the axis Ax that is approximately between about 15 degrees to about 45 degrees. The angled bolt 64 continues through the angled bolt passage 62 and into a angled blade bolt passage 66 formed in the rearward face of the lower blade 63, where the blade angled blade bolt passage registers with the angled bolt passage on the ram block 51. The angled blade bolt passage 66 terminates within the lower blade 63 before reaching a forward face 69 of the lower blade 63. Lower blade 63 slides under upper blade 17 when shearing. An upper edge 65 of lower blade 63 is at a slightly lower elevation than lower edge 21 of upper blade 17. Lower blade 63 has a lower edge 67 that is closer to lower block forward end 53 than the upper edge 65. The face 69 extends between lower edge 67 and upper edge 65 and is thus inclined relative to vertical. As illustrated in FIG. 2, in this example, the inclination of lower blade face 69 is the same as the inclination of upper blade face 23. Lower blade face 69 also recesses to a central area that is closer to lower block forward end 53 than the outboard ends 70 of lower blade 63, as shown in FIGS. 1 and 3. The length of lower blade 63 from one outboard end 70 to the other is the same as the length of upper blade 17 from one outboard end 24 to the other.

Referring to FIG. 4, which shows the bottom of lower block 51, a recess 71 is located on lower shear block 51 along each outboard side outward and rearward from lower blade outboard ends 70. Each recess 71 comprises a space or clearance provided along an outboard side to receive one of the arms 25 when ram blocks 13, 51 are closed. Each recess 71 is defined by an upper side wall 72 and an inboard side wall 74, side walls 72 and 74 being flat and perpendicular in this example. Each recess 71 is aligned with one of the arms 25 to receive the arm when in the closed or sheared position. Each recess 71 has a greater longitudinal length than the length of each arm 25. Also, upper side wall 72 has a greater width than each arm 25, and inboard side wall 74 has a greater height than the height of each arm 25 from its lower side 39 to its upper side 33 (FIG. 2). Recess 71 is not a closed cavity as it has no outboard side wall or bottom side wall. There is no interference between upper side wall 72 and upper side 33 (FIG. 2) of arm 25. There is no interference between inboard side 27 of arm 25 and inboard side wall 74. Arm upper side 33 could optionally slidingly engage recess upper side wall 74, but no vertical forces would be created on lower ram block 51 as a result.

A vertical center point of each arm 25 is approximately the same as a vertical center of lower blade 63. When moving to the closed or sheared position, lower blade 63 will slide between the two arms 25 as the arms enter recesses 71. The outboard ends 70 of lower blade 63 will be closely spaced from the inboard sides 27 of arms 25 as the arms enter recesses 71. A T-shaped connector slot 76 for connection to a piston rod is located on the rearward end of lower block 51.

During manufacturing, the angled bolt passage 28 is formed by boring through the upper ram block 13 starting at the upper surface and through the forward end 15. Angled blade bolt passage 38 is formed by boring through the rearward face of the upper blade 17 such that the blade angled blade bolt passage registers with the angled bolt passage on the ram block 13 when mated. Threads may be formed in the angled blade bolt passage 38 to threadingly engage the angled bolt 26, which may have a threaded exterior profile. A counterbore may be formed in the angled bolt passage 28 in the ram block 13 that corresponds to a head of the angled bolt 26. Additional angled bolts and passages may be formed. Further, bolt passages 20 are formed by boring from the forward face 23 of the upper shearing blade 17 to a rearward face. The bolt passages 20 are formed parallel to axis Ax and form a counterbore at the forward face 23 of the upper shearing blade 17. Each of the plurality of bolts 18 continue into bolt passages 22 (FIGS. 2 and 3) formed on the forward end 15 of the upper ram block 13, and register with the bolt passages 18 of the upper shearing blade 17. The bolts 18 may have a threaded exterior profile to correspond with a threaded inner profile that may be formed in the bolt passages 20, 22. The bolts 18 entering the forward face 23 of the upper blade 17 and angled bolt 26 entering through the upper surface of the ram block 13 to secure the upper blade to the ram block.

Figure 6:
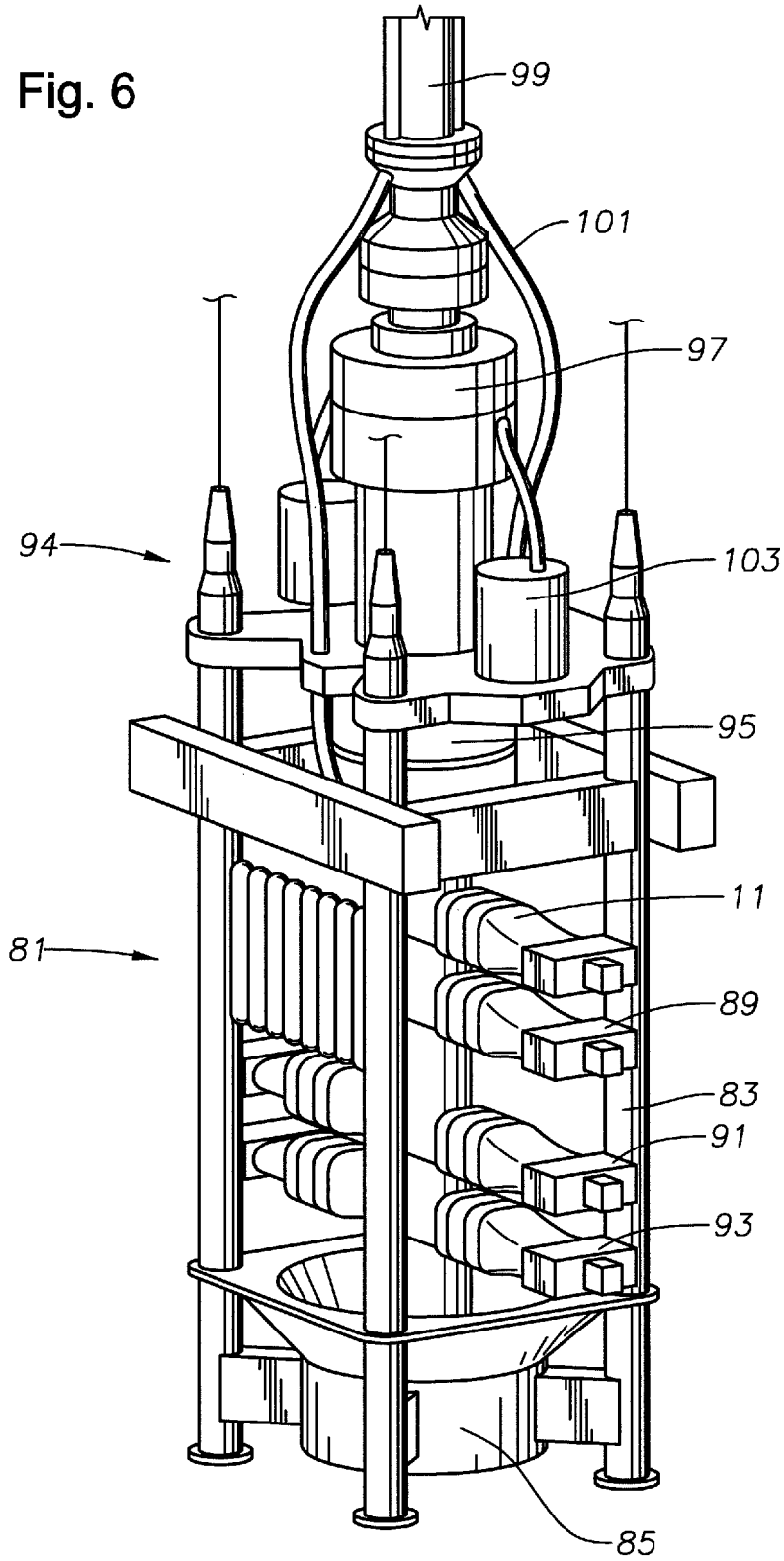
FIG. 6 is a perspective view of a blowout preventer assembly having shear rams in accordance with this disclosure.

FIG. 6 shows blind shear rams 11 installed within a typical subsea blowout preventer assembly. The blowout preventer assembly has a blowout preventer ("BOP") stack 81 that includes a frame with a wellhead connector 85 at the lower end for connecting to a subsea wellhead assembly (not shown). Blind shear rams 11 are normally located above pipe rams, which in this example includes pipe rams 91, 93, and 95. Each pipe ram 91, 93 and 95 has rams with semi-cylindrical recesses on the mating faces for closing around a different size range of pipe. When closed, blind shear rams 11 will seal off the bore and if pipe is present, will shear the pipe.

A lower marine riser package (LMRP) 94 connects to the upper end of BOP stack 81. An annular BOP 95 may be located at the lower end of LMRP 94. Annular BOP 95 will close around any size of pipe and seal the annulus between the pipe and the side wall of the bore. Annular BOP 95 will also seal fully even if a pipe is not present. A flex joint 97 is located at the upper end of LMRP 94 to allow flexing of a lower end of a riser string 99 connected to flex joint 97. Choke and kill lines 101 extend from below annular blowout preventer 95 to alongside riser 99 for pumping fluid into the well. In the event of an emergency, LMRP 94 and riser 99 can be detached from BOP stack 81. Redundant control pods 103 mount to LMRP 94 and contain hydraulic and electrical circuitry for controlling movement of the various rams 11, 81, 91 and 93 annular BOP 95 and other equipment. Control pods 103 are retrievable from LMRP 94 and are connected to an umbilical (not shown) leading to the drilling vessel at the surface.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. An apparatus for shearing pipe within a blowout preventer (BOP), comprising:

a shear ram block having a forward end and a longitudinal axis;

a blade having a forward face;

a rearward face opposite of the forward face, the rearward face in abutment with the forward end of the shear ram block;

a plurality of face bolt passages extending through the blade and into the forward end of the shear ram block;

a face bolt located in each face bolt passages and securing the blade to the shear ram block;

at least one inclined bolt passage extending from an upper surface of the shear ram block downward and inward, out the forward end of the shear ram block and into the blade; and an inclined bolt located in the inclined bolt passage to secure the blade to the shear ram block.

2. The apparatus of claim 1, wherein the inclined bolt passage is oriented such that a vertical plane passing thru the inclined bolt passage is parallel to the longitudinal axis.

3. The apparatus of claim 1, wherein the face bolt passage is oriented such that a vertical plane passing thru the face bolt passage is parallel to the longitudinal axis.

4. The apparatus of claim 1, wherein a counterbore and shoulder are formed in the inclined bolt passage.

5. The apparatus of claim 1, wherein a semi-circular seal groove is formed on the upper surface of the shear ram block and an entrance to the inclined bolt passage is between the seal groove and forward end of the shear ram block.

6. The apparatus of claim 1, wherein two of the inclined bolt passages are each on opposite sides of the longitudinal axis.

7. The apparatus of claim 1, wherein inclined bolt passage has a forward lower end located within the blade.

8. An shear ram assembly for a BOP, comprising:

upper and lower shear ram blocks each having a forward end and a longitudinal axis;

an upper blade having a forward face;

a lower blade having a forward face;

at least one rearward face opposite of at least one of the forward faces, the rearward face in abutment with the forward end of the upper and lower shear ram blocks;

a plurality of face bolt passages extending through at least one of the blades and into the forward end of at least one of the shear ram blocks;

a face bolt located in each face bolt passages and securing at least one of the blades to at least one of the shear ram blocks;

at least one inclined bolt passage extending from an upper surface of the upper shear ram block downward and inward, out the forward end of the upper shear ram block and into the upper blade; and an inclined bolt located in the inclined bolt passage to secure the upper blade to the upper shear ram block.

9. The assembly of claim 1 further comprising:

at least one inclined bolt passage extending from a lower surface of the lower shear ram block upward and inward, out the forward end of the lower shear ram block and into the lower blade; and an inclined bolt located in the inclined bolt passage to secure the lower blade to the lower shear ram block.

10. The apparatus of claim 8, wherein the inclined bolt passage is oriented such that a vertical plane passing thru the inclined bolt passage is parallel to the longitudinal axis.

11. The apparatus of claim 8, wherein the face bolt passage is oriented such that a vertical plane passing thru the face bolt passage is parallel to the longitudinal axis.

12. The apparatus of claim 8, wherein a counterbore and shoulder are formed in the inclined bolt passage.

13. The apparatus of claim 8, wherein a semi-circular seal groove is formed on the upper surface of the shear ram block and an entrance to the inclined bolt passage is between the seal groove and the forward end of the shear ram block.

14. The apparatus of claim 8, wherein two of the inclined bolt passages are each on opposite sides of the longitudinal axis.

15. The apparatus of claim 8, wherein the inclined bolt passage has a forward lower end located within the upper blade.

16. A method for attaching a shear blade to a ram block mounted to a blowout preventer (BOP), the method comprising:

boring a first passage from an upper surface of the ram block to a forward end of the ram block;

boring a second passage in a rearward face of the shear blade, wherein the second passage registers with the first passage at an interface formed by the forward end of the ram block and the rearward face of the shear blade; and attaching the shear blade to the ram block with a bolt that engages the first passage and second passage;

the first and second passages bored at an angle relative to a horizontal axis, the angle being approximately in a range between about 15 degrees to about 45 degrees.

17. The method of claim 16, wherein the second passage terminates within the shear blade.

18. The method of claim 16, wherein a front bolt connects the shear blade to the ram block, the from bolt entering a forward face of the shear blade and into the ram block via a passage that extends through the shear blade and registers with a passage in the ram block, wherein said bolt and passages are parallel to a horizontal axis.

* * * * *